United States Patent [19]

Sheetz

[11] 3,970,268

[45] July 20, 1976

[54] REEL COMPRISING REEL HALVES

[75] Inventor: George A. Sheetz, Summerville, S.C.

[73] Assignee: Larry Harold Kline, Charleston, S.C.

[22] Filed: Nov. 11, 1974

[21] Appl. No.: 522,572

[52] U.S. Cl. ..... 242/115; 242/118.4

[51] Int. Cl.[2] ..... B65H 75/22; B65H 75/14

[58] Field of Search ..... 242/77, 85, 115, 118.4, 242/118.6, 118.8, 125.1

[56] References Cited

UNITED STATES PATENTS

| | | | |
|---|---|---|---|
| 1,739,881 | 12/1929 | Wermine | 242/118.6 |
| 1,747,486 | 2/1930 | Ridgway | 116/DIG. 41 |
| 1,784,236 | 12/1930 | Jones | 116/DIG. 41 |
| 3,536,275 | 10/1970 | Salomon | 242/85 |
| 3,717,315 | 2/1973 | Kovaleski | 242/115 |
| 3,743,208 | 1/1974 | Schmitz | 242/118.6 |
| 3,784,166 | 1/1974 | Renfroe | 242/117 |

*Primary Examiner*—Leonard D. Christian
*Attorney, Agent, or Firm*—Larry Harold Kline

[57] ABSTRACT

A reel for storing cabled material is disclosed, comprising a first reel half, a second reel half and securing means, said first and second reel halves being nestable and interchangeable.

20 Claims, 6 Drawing Figures

REEL COMPRISING REEL HALVES

This invention relates to reels and more particularly to reels used for storage of cabled material.

Reels presently used for storing cabled material are generally bulky, heavy and difficult to repair and store. Wooden reels now are customarily not re-used, but are burned, broken up, or simply left to rot at various sites. Storage of the wooden reels is expensive and inconvenient.

The present invention solves many basic problems incurred by use of the wooden reels. By using the present invention, reels are available which are nestable, when empty; easily storable, when full; durable; easily repaired or replaced; permanently color-coded; stronger and lighter than wooden reels; and easily manufactured and shipped.

This specification discloses two distinct innovations with regard to reels. One of these innovations is claimed in detail in this patent application and the other is claimed in a simultaneously-filed patent application by the same inventor. Both of these innovations will be discussed in this specification.

An object of the present invention is to provide a reel with interchangeable parts for storing cabled material.

A further object of this invention is to provide a reel which is stronger and lighter than wooden reels.

A further object of this invention is to provide a reel which would require a minimum of storage space and a maximum of physical stability while being stored.

Still a further object of this invention is to provide a reel with parts that can nest for storage and shipping purposes.

Another object of this invention is to provide a reel which is re-useable and returnable.

Another object of this invention is to provide a reel which would reduce the overall expense in the use of cable reels.

A further object of this invention is to provide a reel which could be pigmented for a permanent color-coding which would not wear off or be painted over.

These and other objects and features of the invention will be apparent from the following description and appended claims.

Briefly, the first of the two distinct innovations with regards to reels is a reel for storing cabled material comprising a first reel half, a second reel half and securing means holding the first reel half to the second reel half. The first reel half may comprise a first disk and a first cabled material holding section attached to the first disk. The outside diameter of the larger diameter portion of the first cabled material holding section is smaller than the diameter of the first disk. The second reel half may comprise a second disk and a second cabled material holding section attached to the second disk. The outside diameter of the larger diameter portion of the second cabled material holding section is smaller than the diameter of the second disk. The first cabled material holding section comprises a first hole with the diameter larger than the diameter of the cabled material, whereby the cabled material may fit through the hole. The first cabled material holding section may have the shape of the frustum of a first cone with a larger diameter edge and a smaller diameter edge, with the larger diameter edge being attached to the first disk and the smaller diameter edge having a first bottom piece attached. The second cabled material holding section may be in the shape of the frustum of a second cone with a larger diameter edge and a smaller diameter edge, with the larger diameter edge being attached to the second disk, and the smaller diameter edge having a second bottom piece affixed. A first convex extension may be attached to the first bottom piece of the frustum of a first cone. A first concave indentation of similar size as the first convex extension may be indented into the first bottom piece of the frustum of a first cone at a point 180° from the first convex extension. A second convex extension may be attached to the second bottom piece of the frustum of a second cone. A second concave indentation of similar size as the second convex extension may be indented into the second bottom piece of the frustum of a second cone at a point 180° from the second convex extension. The first disk may comprise an opening having a diameter larger than the diameter of the smaller diameter edge of the frustum of a first cone. The opening in the first disk may have a diameter that is not greater than the larger diameter edge of the frustum of a first cone. The opening in the first disk may have a diameter equal to the diameter of the larger diameter edge of the frustum of a first cone. The second disk may comprise an opening having a diameter larger than the diameter of the smaller diameter edge of the frustum of a second cone. The opening in the second disk may have a diameter that is not greater than the larger diameter edge of the frustum of a second cone. The opening in the second disk may have a diameter equal to the diameter of the larger diameter edge of the frustum of a second cone. The first disk may comprise a plurality of indentations. The securing means may comprise a plurality of first braces, a plurality of second braces, and a plurality of bolting means. When the first reel half is mated to the second reel half, the plurality of first braces may be placed against the first reel half, and the plurality of second braces may be placed against the second reel half, with the plurality of bolting means passing through the plurality of first braces, the first reel half, the second reel half, and the plurality of second braces, and being bolted, thereby securing the first reel half to the second reel half to form a reel operative to store the cabled material. When the first reel half is mated to the second reel half, the first bottom piece of the frustum of a first cone may rest against the second bottom piece of the frustum of a second cone. The first convex extension may rest in the second concave indentation. The second convex extension may rest in the first concave indentation. The first disk may comprise a plurality of first indentations. The second disk may comprise a plurality of second indentations. The plurality of first braces may be placed in the plurality of first indentations. The plurality of second braces may be placed in the plurality of second indentations. The plurality of bolting means may comprise a plurality of bolts threaded at each end and a plurality of nuts fitting the plurality of bolts. The plurality of bolts may pass through the plurality of first braces, the first reel half, the second reel half, and the plurality of second braces. Each of the plurality of bolts may then be secured on each of its ends by one of the plurality of nuts. The cabled material may be passed through the first hole in the first cabled material holding section and attached to the first disk. The cabled material may then be spindled over the first cabled material holding section and the second cabled material holding section. The first reel half may nest for storage and shipping purposes on the second reel half. The first reel half and the second reel half may be permanently color-coded for various purposes. The first reel half and the second reel half may be substantially identical and may be interchanged. The first reel half and the second reel half may be manufactured from any synthetic material.

Briefly, the second distinct innovation with regard to reels is a reel for storing cabled material comprising a first central section piece, a second central section piece, which may be placed against the first central section piece to form a center portion with two ends, a first end piece to which one of the two ends of the center portion may be pressed, a second end piece, to which the other of the two ends of the center portion may be pressed, and holding means operative to hold the first central section piece, the second central section piece, the first end piece, and the second end piece pressed together. The first central section piece and the second central section piece may be substantially identical and interchangeable. The first end piece and the second end piece may be substantially identical and interchangeable. The first central section piece and the second central section piece may be half cylinders which when pressed together form a cylinder. Each end disk may comprise an indented circular slot, whereby either end of the cylinder formed by pressing the half cylinders together, will fit into the slot. Each end disk may comprise a plurality of supporting ribs and a supporting rim. Each slot may further act as a supporting ridge. The first central section piece and the second central section piece may each contain a plurality of holes, with a diameter larger than the diameter of the cabled material, whereby the cabled material may fit through the plurality of holes. The first end piece and the second end piece may each contain a plurality of holes, with a diameter larger than the diameter of the cabled material, whereby the cabled material may fit through the plurality of holes. Each end disk may contain a plurality of openings for the holding means to pass through. The holding means may comprise a bolt of sufficient length to pass through the cylinder and both of the end disks, with the bolt having a head of a diameter larger than the diameter of the plurality of openings in each end disk. The holding means may further comprise a nut operative to hold the bolt and therefore to hold each end disk to the cylinder, and a plurality of washers operative to aid the bolt and the nut to hold each end disk to the cylinder. The first central section piece may nest into the second central section piece for storage or shipping purposes. The first end piece may be stacked onto the second end piece for storage or shipping purposes. The first central section piece, the second central section piece, the first end piece, or the second end piece may be manufactured from any strong, lightweight material such as fiberglass-reinforced plastic, or any synthetic material. The reel may be permanently color-coded for various purposes. The permanent color-coding may be accomplished by impregnating material with pre-designated pigment. The bolt may be hollow so that the reel may be mountable on a reel spindle for various reeling purposes.

The invention will be more fully understood from the following detailed description and appended claims when taken with the drawings in which:

Figure 1:
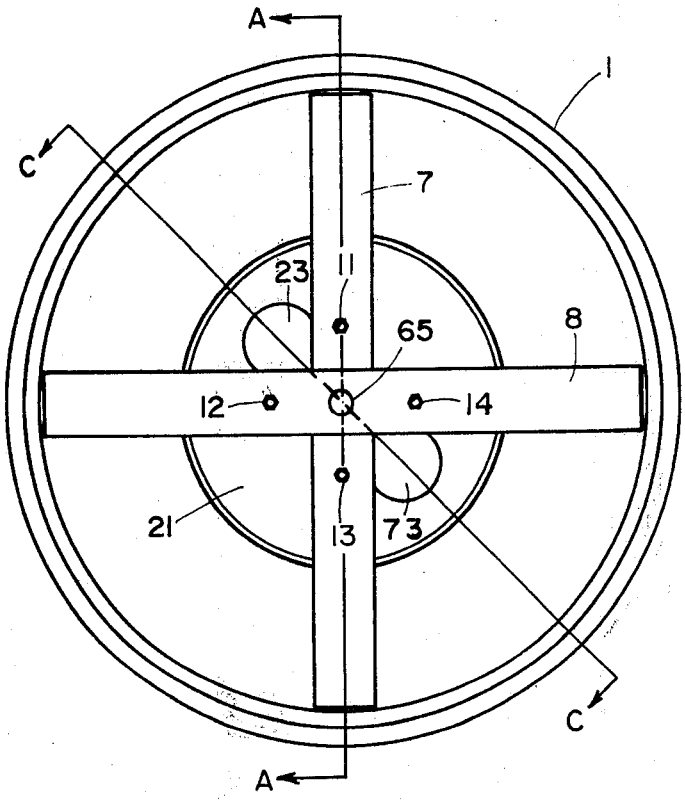
FIG. 1 is an end view of a reel which comprises two reel halves for storing cabled material.

Referring now to the drawings, FIG. 1 is an end view of the reel which comprises two reel halves for storing cabled material. First disk 1 is shown in the end view. Cross-member braces 7 and 8 lie in indentations in first disk 1. Nuts 12 and 14 shown on cross-member brace 8, and nuts 11 and 13 shown on cross-member brace 7, hold various spanner bolts that extend through first disk 1. Spindling hole 65 may be drilled through cross-member braces 7 and 8 to provide the capability for mounting the reel on a reel spindle for various reeling purposes.

Figure 2:
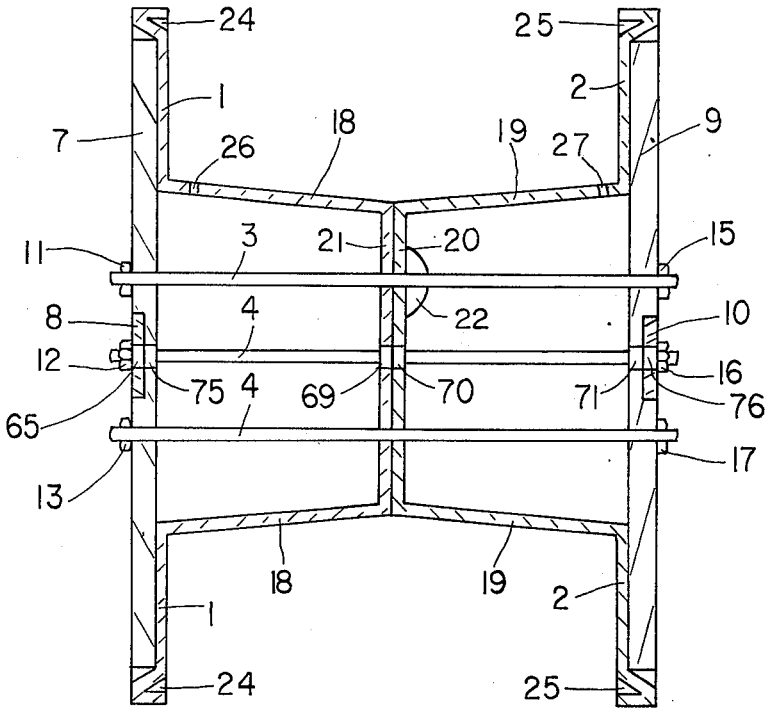
FIG. 2 is a cross-sectional view of plane A—A of FIG. 1.

FIG. 2 is a cross-sectional view of plane A—A of FIG. 1. First disk 1 and frustum 18 form a first reel half. Second disk 2 and frustum 19 form a second reel half. Frustum 18 has the shape of the frustum of a cone, with a larger diameter edge and a smaller diameter edge, and forms a first cabled material holding section. Bottom 21 is attached to the smaller diameter edge of frustum 18. Frustum 19 has the shape of the frustum of a second cone with a larger diameter edge and a smaller diameter edge. Bottom 20 is attached to the smaller diameter edge of frustum 19, with the larger diameter edge attached to second disk 2, with a first reel half formed by first disk 1 and frustum 18 pressed to a second reel half formed by second disk 2 and frustum 19 by securing means. The securing means as shown in FIGS. 2 and 1 are a plurality of first braces such as cross-member brace 7 and cross-member brace 8 on disk 1. The securing means further comprises a plurality of second braces such as cross-member brace 9 and cross-member brace 10 on disk 2. The securing means further comprises a plurality of bolting means such as spanner bolts 3, 4, 5, and 6 (not seen in FIG. 2). Spanner bolt 3 extends through the first reel half and second reel half and is secured against first disk 1 by nut 11, and against second disk 2 by nut 15. Spanner bolt 4 extends through the first reel half and the second reel half and is secured against disk 1 by nut 12, and is secured against disk 2 by nut 16. Spanner bolt 5 extends through the first reel half and the second reel half, and is secured against disk 1 by nut 13, and is secured against disk 2 by nut 17. Spanner bolt 6 is not seen in FIG. 2, and is only shown in FIG. 1 by the end of spanner bolt 6, where nut 14, which is secured on on end of spanner bolt 6, is shown. In FIG. 2 the first reel half is shown secured against the second reel half. A convex extension 23 is attached to bottom 21. A concave indentation 22 (shown in FIG. 3) is indented on bottom 20. When the first reel half and the second reel half are pressed together the convex extension 23 on bottom 21 fits into the concave indentation 22 indented on bottom 20. At a point 180° from the convex extension 23 on frustum 18 is a concave indentation similar to concave indentation 22 on frustum 19. Looking at bottom 20, at a point 180° from the concave indentation 22 on bottom 20 is a convex extension 74 on bottom 20 similar to convex extension 23 on bottom 21. When the first reel half and the second reel half are pressed together the convex extension 74 on bottom 20 fits into the concave indentation 73 on bottom 21 in a similar manner that convex extension 23 fits into concave indentation 22. Any number of similar concave indentations and convex extensions can be used about the 360° bottom of the frustum, as long as they are placed symetrically with similar diameters for the indentations and extensions.

If desired, the bottom attached to the smaller diameter edge frustum can be eliminated. Symmetrical convex extensions and concave indentations can be placed about the circumference of the smaller diameter edge. The concave extensions on one reel half will fit into the corresponding concave indentations of a mating reel half.

Any number of similar concave indentations and concave extensions may be used about the 360° edge of the smaller diameter edge of the frustums which are placed symmetrically so that the convex extension on one frustum will always fit into the concave indentation on the other frustum when pressed together. These extensions within the indentations further add stability and strength to the entire reel. When the frustums are pressed together, the rest of the connecting edges are pressed together to form a continuous edge, enhancing the stability of the reel.

Disk 1 has a circular slot 24 and disk 2 has a circular slot 25. These slots 24 and 25 do not protrude beyond the inside plane of the disks 1 and 2. Slots 24 and 25 enhance the strength of the reel.

Frustum 18 has a hole 26. Hole 26 has a diameter larger than the diameter of the cabled material, so that the cabled material may fit through the hole. Frustum 19 has a hole 27. Hole 27 has a diameter larger than the diameter of the cabled material, so that the cabled material may fit through the hole. The cabled material may be fed through hole 26 in frustum 18 and out through area 66 in disk 1. If desired, the cabled material can be placed through hole 27 in frustum 19 and out through the open area (not shown) in disk 2. The cabled material that is pulled through hole 26 and through open area 66 in disk 1 may be attached to the disk 1, or may be attached to the cross-member braces 7 or 8, by stapling or any other means. Cabled material pulled through hole 27 and through the open area (not shown) on disk 2 may be attached to disk 2 or to cross-member braces 9 and 10, by stapling or any other means available.

In order to spindle the reel, it may be necessary that a spindle axle or mandrel be placed through the center axis of the assembled reel. As shown in FIG. 2, spindling is possible with this invention. Hole 65 in cross-member brace 8, along with hole 75 in cross-member brace 7, along with open area 66 in disk 1, allow access for the spindle axle. Hole 69 in bottom 21 of frustum 18 and hole 70 in bottom 20 of frustum 19 allow access for the spindle axle. Hole 71 in cross-member brace 9, and hole 76 in cross-member brace 10, along with the open area (not shown) in disk 2, complete the path for access for the spindle axle.

Figure 3:
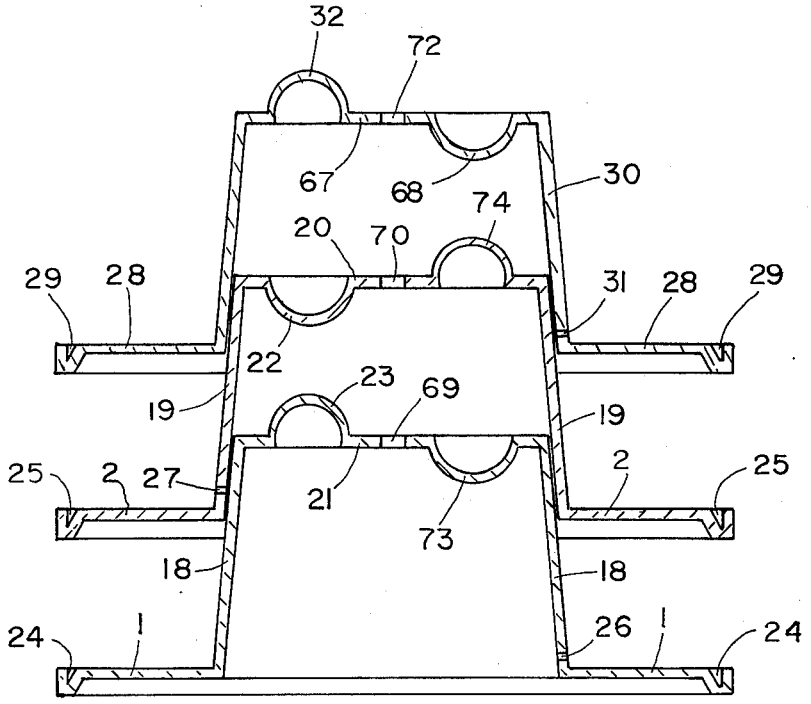
FIG. 3 is a cross-sectional view of three nested reel halves, the two reel halves in FIG. 1 taken cross-sectionally at plane C—C and a similarly-viewed third reel half.

FIG. 3 is a cross-sectional view of three nested reel halves. FIG. 3 shows the two reel halves which are shown in FIG. 2, taken cross-sectionally at plane C—C in FIG. 1, and a third reel half. The third reel half, similarly viewed, comprises disk 28 and frustum 30, which is connected to disk 28. The three reel halves are nested for storage or shipping purposes. Frustum 18 fits through the open area in disk 2. Frustum 19 fits through the open area in disk 28. Disk 28 has a slot 29 which is similar to the slot 24 in disk 1, and the slot 25 in disk 2. A convex extension 32 is shown connected to bottom 67, which is connected to the smaller diameter edge of frustum 30. A hole 31 is shown in frustum 30. Hole 31 is similar to hole 26 in frustum 18 and hole 27 in frustum 19. Concave indentation 68 is shown on bottom 67. Hole 72 on bottom 67 provides access for a spindling axle, similar to hole 70 in bottom 20 and hole 69 in bottom 21.

Figure 4:
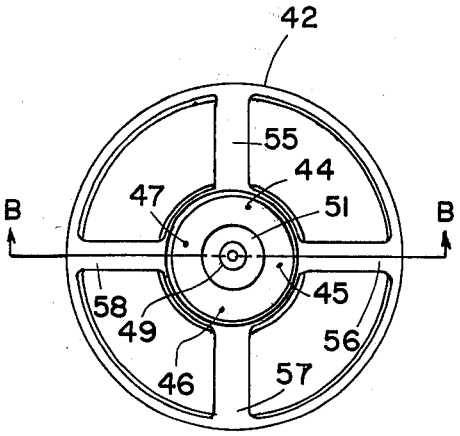
FIG. 4 is an end view of a reel which comprises two section pieces and two end pieces for storing cabled material.

FIG. 4 is an end view of a reel which comprises two central section pieces and two end pieces for storing cabled material. FIG. 4 shows a first end piece or end disk 42. End disk 42 has supporting ribs 55, 56, 57, and 58. End disk 42 has holes 44, 45, 46, and 47. Holes 44, 45, 46, and 47 are of a diameter larger than the diameter of the cabled material to be spindled, and the cabled material will fit through the holes. Head 49 of bolt 48, (which is shown in FIG. 6), is shown pressed against washer 51.

Figure 5:
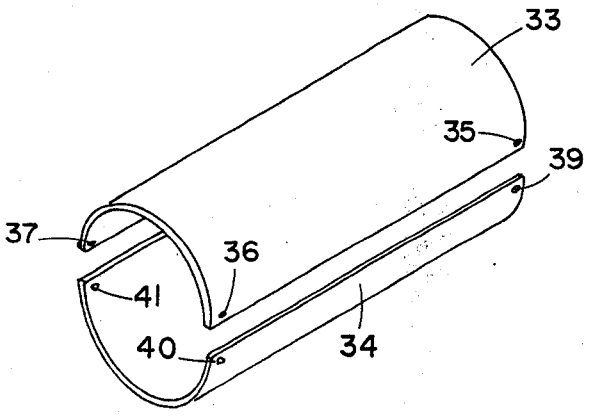
FIG. 5 is an isometric view of two central section pieces.

FIG. 5 is an isometric view of two central section pieces. Central section piece 33 is a half-cylinder. Central section piece 34 is an identical half-cylinder to half-cylinder 33. Half-cylinder 33 has holes 35, 36, 37, and 38, (shown in FIG. 6). Half-cylinder 34 has holes 39, 40, 41, and one hole not shown which is located in a position diametrically opposite to hole 39.

Figure 6:
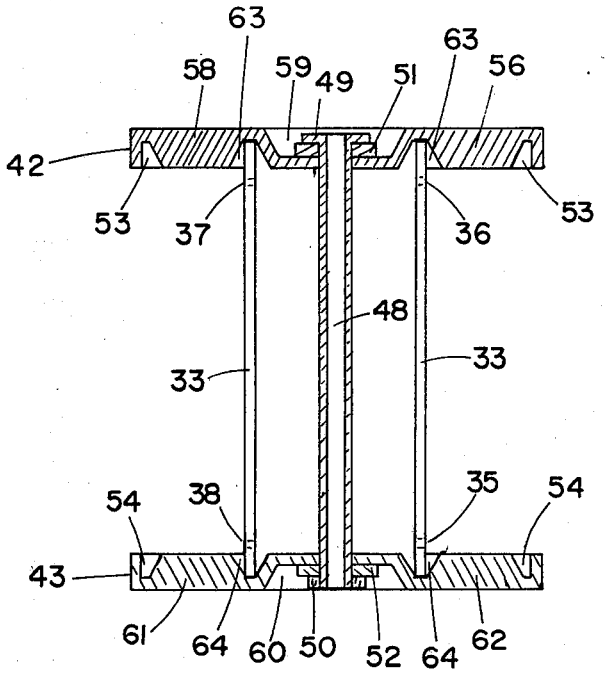
FIG. 6 is a cross-sectional view of plane B—B of FIG. 4.

FIG. 6 is a cross-sectional view of plane B—B of FIG. 4. The reel shown in FIG. 4 comprises a first central section piece 34, a second central section piece 33, which is pressed against first central section piece 34 to form a center portion with two ends. The two ends are pressed into slots in two end pieces, and held together by holding means. FIG. 6 shows a cross-section showing central section piece 33 with the ends of central section piece 33 pressed into slot 63 in end disk 42, and slot 64 in end disk 43. Slots 63 and 64 also serve as supporting ridges for the ends of central section pieces 33 and 34. End disk 42 has a supporting rim 53 and inner hub 59, along with slot 63. End disk 43 has a supporting rim 54 and inner hub 60, along with slot 64. Bolt 48 is shown extending through central section piece 33 and central section piece 34. Head 49 of bolt 48 presses against washer 51, which presses against end disk 42. Nut 50 presses against washer 52, which presses against end disk 43. Bolt 48, nut 50 and washers 51 and 52 comprise the holding means for the reel, and hold together end disk 42, end disk 43, half-cylinder 33, and half-cylinder 34, thereby forming the reel.

Disk 43 has supporting ribs 61 and 62, along with two other supporting ribs not shown, which are similar to supporting ribs 55, 56, 57 and 58 of end disk 42. Central section piece or half-cylinder 33 is substantially identical and interchangeable with central section piece or half-cylinder 34. End piece or end disk 42 is substantially identical and interchangeable with end disk or end piece 43. Central section piece 33, central section piece 34, end disk 42, and end disk 43 all contain a plurality of holes with the diameter larger than the diameter of the cabled material, whereby the cabled material may fit through the plurality of holes in either half-cylinder 33 or half-cylinder 34, and pulled through any of the plurality of holes of end disk 42 or end disk 43, and fastened or stapled by any means to end disk 42 or end disk 43. The cabled material may be fastened in the inner hub 59 of end disk 42 or the inner hub 60 of end disk 43, where the fastened cabled material will have no effect on the physical stability of the reels if they are stacked one on top of the other when loaded with cabled material. The cabled material fastened in inner hub 59 and inner hub 60 will not be above the plane formed by the outer area of the various supporting ribs, which will be in contact with other supporting ribs if and when the filled reels are stacked. Head 49 of bolt 48 and the nut 50, along with the washers will all be contained in the inner hubs so as not to interfere with the stacking of the reels.

Central section piece 33 will nest into central section piece 34 for storage or shipping purposes. End disk 42 will stack onto end disk 43 for storage or shipping purposes. Central section piece 33, central section piece 34, end piece 42 or end piece 43 may be manufactured from any strong lightweight material such as fiberglass-reinforced plastic, or from any synthetic material, and may be permanently color-coded for various purposes by any means, including impregnating material with pre-designated pigment. For example, different colored pigments can indicate different sizes of cabled materials or any other coded message desired by the users of the invention.

Bolt 48 may be hollow so that the reel may be mountable on a reel spindle for various reeling purposes.

Half-cylinders 33 and 34 have the same length and the same radius. Disks 42 and 43 are identical. Half-cylinders 33 and 34 may be pressed together to form a cylinder. The cylinder sits into the indented circular slot in each disk, aiding in preventing the cylinder from slipping on the disk. The disk itself has reinforcing ribs and the indentation which accomodates the cylinder also acts as a reinforcing ridge.

At the outer circumference of each of the disks, the disk is molded in such a way as to provide a reinforced rim. The reinforcement helps to maintain the integrity of the rim when the reel is rolled or placed onto the floor with the weight of a cable or wire on it. When the cylinder is placed in between two disks, the two disks are compressed by holding means which may be bolts, or which could be any type of holding means.

Both of the reels discussed in this specification, one of which is claimed in this patent application, meet the goals of the objects as previously discussed. Both reels are nestable when empty, easily storable when full. The reels are made of durable material and may be easily repaired or replaced. They may be permanently color-coded. They are stronger and lighter than wooden reels and may be easily manufactured and shipped.

If one central section piece is damaged, it may be replaced by simply another central section piece. If one end piece is damaged it may be replaced by another end piece. If one reel half is damaged, it may be replaced by another reel half. All of these features add to easy repair and replacement, and to a reel with interchangeable parts, that can nest for storage and shipping purposes, that is reusable and returnable, that requires a minimum of storage space and a maximum of physical stability while being stored, that can be pigmented for permanent color-coding, and that will reduce the overall expense in the use of cabled reels.

While the invention has been described with reference to specific embodiments, the description is illustrative and is not to be construed as limiting the scope of the invention. Various modifications and changes may occur to those skilled in the art, without departing from the spirit and the scope of the invention as defined by the appended claims.

I claim:

1. A reel for storing cabled material comprising:

a. a first reel half comprising a first disk; a first cabled material holding section, attached to said first disk, wherein the outside diameter of the larger diameter portion of said first cabled material holding section is smaller than the diameter of said first disk, and wherein said first cabled material holding section has the shape of the frustum of a first cone with a larger diameter edge and a smaller diameter edge with said larger diameter edge of said frustum of a first cone attached to said first disk;

b. a second reel half comprising a second disk; and a second cabled material holding section, attached to said second disk, wherein the outside diameter of the larger diameter portion of said second cabled material holding section is smaller than the diameter of said second disk;

c. securing means holding said first reel half to said second reel half to form a reel operative to store said cabled material.

2. A reel according to claim 1 wherein said first cabled material holding section comprises a first hole with a diameter larger than the diameter of said cabled material whereby said cabled material may fit through said hole and wherein said second cabled material holding section comprises a second hole with a diameter larger than the diameter of said cabled material whereby said cabled material may fit through said hole.

3. A reel according to claim 1 wherein said second cabled material holding section has the shape of the frustum of a second cone with a larger diameter edge and a smaller diameter edge with said larger diameter edge of said frustum of a second cone attached to said second disk.

4. A reel according to claim 3 wherein said frustum of a first cone has a first bottom piece affixed at said smaller diameter edge and a first convex extension is attached to said first bottom piece of said smaller diameter edge of said frustum of a first cone and a first concave indentation, of similar size as said first convex extension, is indented into said first bottom piece of said smaller diameter edge of said frustum of a first cone, at a point 180° from said first convex extension, and wherein said frustum of a second cone has a second bottom piece affixed at said smaller diameter edge and a second convex extension is attached to said second bottom piece of said smaller diameter edge of said frustum of a second cone and a second concave indentation, of similar size as said second convex extension, is indented into said second bottom piece of said smaller diameter edge of said frustum of a second cone, at a point 180° from said second convex extension.

5. A reel according to claim 3 wherein said first disk comprises an opening having a diameter larger than the diameter of said smaller diameter edge of said frustum of a first cone.

6. A reel according to claim 3 wherein said second disk comprises an opening having a diameter larger than the diameter of said smaller diameter edge of said frustum of a second cone.

7. A reel according to claim 5 wherein said first disk comprises a plurality of indentations.

8. A reel according to claim 1 wherein said securing means comprises:

a. a plurality of first braces;

b. a plurality of second braces; and c. a plurality of bolting means;

whereby when said first reel half is mated with said second reel half, said plurality of first braces is placed against said first reel half and said plurality of second braces is placed against said second reel half, with said plurality of bolting means passing through said plurality of first braces, said first reel half, said second reel half, and said plurality of second braces, and being bolted, thereby securing said first reel half to said second reel half to form a reel operative to store said cabled material.

9. A reel according to claim 3 wherein said frustum of a first cone has a first bottom piece affixed at said smaller diameter edge and a first convex extension is attached to said first bottom piece of said smaller diameter edge of said frustum of a first cone and a first concave indentation, of similar size as said first convex extension, is indented into said first bottom piece of said smaller diameter edge of said frustum of a first cone, at a point 180° from said convex extension.

10. A reel according to claim 9 wherein said frustum of a second cone has a second bottom piece affixed at said smaller diameter edge and a second convex extension is attached to said second bottom piece of said smaller diameter edge of said frustum of a second cone and a second concave indentation, of similar size as said convex extension, is indented into said second bottom piece of said smaller diameter edge of said frustum of a second cone, at a point 180° from said second convex extension.

11. A reel according to claim 10 wherein said first cabled material holding section comprises a first hole with a diameter larger than the diameter of said cabled material whereby said cabled material may fit through said hole, and wherein said second cabled material holding section comprises a second hole with a diameter larger than the diameter of said cabled material whereby said cabled material may fit through said hole.

12. A reel according to claim 11 wherein said securing means comprises:

a. a plurality of first braces;

b. a plurality of second braces; and c. a plurality of bolting means;

whereby, when said first reel half is mated with said second reel half, said plurality of first braces is placed against said first reel half and said plurality of second braces is placed against said second reel half, with said plurality of bolting means passing through said plurality of first braces, said first reel half, said second reel half, and said plurality of second braces, and being bolted, thereby securing said first reel half to said second half to form a reel operative to store said cabled material.

13. A reel according to claim 12 wherein when said first reel half is mated to said second reel half, said first bottom piece of said frustum of a first cone rests against said second bottom piece of said frustum of a second cone, said first convex extension rests in said second concave indentation, and said second convex extension rests in said first concave indentation.

14. A reel according to claim 13 wherein said first disk comprises a plurality of first indentations and said second disk comprises a plurality of second indentations;

whereby said plurality of first braces may be placed in said plurality of first indentations and said plurality of second braces may be placed in said plurality of second indentations.

15. A reel according to claim 14 wherein said plurality of bolting means comprises a plurality of bolts threaded at each end, and a plurality of nuts fitting said plurality of bolts;

whereby said plurality of bolts passes through said plurality of first braces, said first reel half, said second reel half, and said plurality of second braces, and each of said plurality of bolts is secured on both ends by one of said plurality of nuts.

16. A reel according to claim 15 wherein said cabled material is passed through said first hole in said first cabled material holding section and attached to said first disk thereby allowing said cabled material to be spindled over said first cabled material holding section and said second cabled material holding section.

17. A reel according to claim 3 wherein said first reel half will nest on said second reel half for storage or shipping purposes.

18. A reel according to claim 1 wherein said first reel half and said second reel half may be permanently color-coded for various purposes.

19. A reel according to claim 1 wherein said first reel half and said second reel half are substantially identical and may be interchanged.

20. A reel according to claim 1 wherein said first reel half and said second reel half may be manufactured from any synthetic material.

* * * * *